US007913763B2

(12) United States Patent
D'Amico

(10) Patent No.: US 7,913,763 B2
(45) Date of Patent: Mar. 29, 2011

(54) WASHING A CYLINDRICAL CAVITY

(75) Inventor: Giovanni D'Amico, Chieti (IT)

(73) Assignee: Weatherford Mediterranea S.p.A., Ortona (IT)

( * ) Notice: Subject to any disclaimer, the term of this patent is extended or adjusted under 35 U.S.C. 154(b) by 174 days.

(21) Appl. No.: 12/095,109

(22) PCT Filed: Nov. 23, 2006

(86) PCT No.: PCT/EP2006/068800

§ 371 (c)(1),
(2), (4) Date: Aug. 18, 2008

(87) PCT Pub. No.: WO2007/063022

PCT Pub. Date: Jun. 7, 2007

(65) Prior Publication Data

US 2008/0308269 A1 Dec. 18, 2008

(30) Foreign Application Priority Data

Nov. 29, 2005 (IT) ..... MI2005A2280

(51) Int. Cl.
*E21B 37/00* (2006.01)
*E21B 21/14* (2006.01)

(52) U.S. Cl. ..... 166/311; 166/222

(58) Field of Classification Search ..... 175/424; 166/311, 312, 222, 223, 70; 239/554, 556–560
See application file for complete search history.

(56) References Cited

U.S. PATENT DOCUMENTS

| | | | | | |
|---|---|---|---|---|---|
| 72,348 | A | * | 12/1867 | Wheeler | 239/568 |
| 1,375,106 | A | * | 4/1921 | Pfeiffer et al. | 166/105 |
| 2,466,182 | A | * | 4/1949 | Peeps | 239/427.3 |
| 3,593,786 | A | * | 7/1971 | Lewis | 166/222 |
| 4,037,660 | A | * | 7/1977 | Newsom et al. | 166/302 |
| 4,436,166 | A | | 3/1984 | Hayatdavoudi et al. | |
| 4,567,934 | A | * | 2/1986 | Nakao et al. | 164/444 |
| 4,677,997 | A | | 7/1987 | Strauss | |
| 5,337,819 | A | * | 8/1994 | Tailby | 166/222 |
| 5,375,378 | A | * | 12/1994 | Rooney | 451/38 |
| 5,533,571 | A | | 7/1996 | Surjaatmadja et al. | |
| 5,551,458 | A | * | 9/1996 | Faxon | 134/22.12 |
| 6,189,618 | B1 | * | 2/2001 | Beeman et al. | 166/312 |
| 6,325,305 | B1 | * | 12/2001 | Kuhlman et al. | 239/548 |
| 6,454,009 | B2 | * | 9/2002 | Carmichael et al. | 166/311 |
| 7,152,679 | B2 | | 12/2006 | Simpson | |

FOREIGN PATENT DOCUMENTS

WO WO 2004/033842 4/2004

OTHER PUBLICATIONS

International Preliminary Report on Patentability from Application No. PCT/EP2006/068800 dated Jun. 3, 2008.

* cited by examiner

*Primary Examiner* — Kenneth Thompson
(74) *Attorney, Agent, or Firm* — Patterson & Sheridan, LLP

(57) ABSTRACT

A tool (2) for washing a wellbore or hollow tubular has a longitudinal axis and comprises one or more elongate nozzles (7) for ejecting fluid generally radially from the tool. The or each nozzle extends circumferentially around the tool so as to provide a continuous stationary jet of fluid. Preferably the nozzles collectively provide 360° around the tool.

48 Claims, 6 Drawing Sheets

WASHING A CYLINDRICAL CAVITY

The present invention relates to a methods and apparatuses for washing generally cylindrical cavities. In particular, the invention relates to washing and/or spraying the walls of pipelines and wells such as mineral wells, geothermal wells, oil wells and natural gas wells.

Tools for generating jets of fluid for washing the interior of cylindrical cavities are well known. Such tools are used, for example, for washing the walls of wells, and removing deposits, scale and debris from the walls of the wells. Such tools may also be used to treat rock pores or the interstices in the wall coatings to increase their permeability to improve other chemical and physical characteristics.

The composition of the washing fluid used may vary. Water is frequently used, sometimes with additives such as hydrochloric acid (HCl), polymers, abrasive dust, nitrogen ($N_2$), nitrogenous liquids etc.

A known washing system involves the use of generally cylindrical tools having one or more punctiform nozzles from which the washing fluid is ejected. The nozzles are mounted on a rotating head, the rotation being driven by the fluid leaving the nozzles. The washing fluid exits the tool in a set of rotating punctiform jets which strike the walls of the well.

These tools are costly. The presence of moving parts and a rapidly rotating head leads to reliability problems. The speed of rotation is very difficult to control. In addition, since some of the energy in the washing fluid is used to make the nozzles rotate, there is less energy in the jets striking the wall than would be the case with no rotation.

Furthermore, it will be appreciated that, because the jets are constantly moving, each jet plays on a particular part of the wall for a very short time. This substantially diminishes the washing effect because of the intermittent nature of the jet and the inertia of the fluids present in the well.

Another known washing system involves the use of tools having an array of stationary punctiform nozzles. Such tools are again usually generally cylindrical in form, and the nozzles are distributed along and around the periphery of the tool. Washing fluid is ejected from the nozzles in an array of stationary punctiform jets. Such tools are cheaper and more reliable than those with rotating nozzles.

However, stationary punctiform jets do not achieve a uniform washing action over the area to be washed. The high number of nozzles considerably reduces the exit speed of each jet and consequently the efficiency of the treatment.

In accordance with one aspect of the present invention there is provided a tool for washing a wellbore or hollow tubular, the tool having a longitudinal axis and comprising one or more elongate nozzles for ejecting fluid generally radially from the tool, the or each nozzle extending circumferentially around the tool. The nozzle or nozzles preferably collectively extend 360° around the longitudinal axis of the tool so that fluid is ejected in all radial directions.

The term "fluid" as used herein is intended to encompass washing fluid, sandblasting fluid, abrasive material etc. that may be useful for washing and/or abrasive cleaning of a wellbore or tubular. The tool may also be useful for cutting tubulars, in which case a suitable material should be selected.

Where there is more than one nozzle, the nozzles preferably have complementary circumferential extensions so that they collectively extend a predetermined circumferential distance (usually 360°) around the tool. This may be achieved by locating the nozzles at a variety of axial locations.

The nozzles may be provided in a number of different configurations. For example, each nozzle may extend in a plane normal to the longitudinal axis. Alternatively, some or all of the nozzles may include an axial component in their direction of extension. The nozzles may extend in a plane inclined to the longitudinal axis. Some or all of the nozzles may be formed as curved slots. Further configurations may also be envisaged.

The nozzles may be arranged so that fluid exits the tool in a purely radial direction with no axial component—i.e. straight out from the tool. Alternatively, the nozzles may be inclined so that fluid exits in a direction inclined axially to the radial direction. The nozzles may be straight, or divergent so that fluid exits the tool at a range of angles relative to purely radial, or convergent. The tool may comprise a body surrounding a central cavity for receiving fluid, the nozzles extending through the body from the central cavity to the exterior of the tool.

In one embodiment, a single nozzle extends 360° around the longitudinal axis of the tool. The axial width of this nozzle may be adjustable.

In order to provide adjustment of the width of the nozzle, the tool may comprise a generally tubular assembly comprising a larger external diameter portion and a smaller external diameter portion with a shoulder therebetween, at least a part of the smaller diameter portion being externally threaded, and a sleeve, at least partially internally threaded, screwed onto the smaller external diameter portion of the tubular assembly, such that the nozzle is formed between an end of the sleeve and the shoulder, the axial width of the nozzle being determined by the extent to which the sleeve is screwed onto the smaller diameter portion. An annular chamber is preferably formed adjacent to the nozzle, the tool arranged so that the annular chamber is in fluid communication with fluid supplied to the tool.

Preferably the sleeve and tubular assembly are lockable together to prevent relative axial movement therebetween. This may be achieved, for example, using grub screws passing through the sleeve.

The generally tubular assembly preferably comprises a central cavity, with ports being provided in the smaller diameter portion to provide fluid communication between the central cavity and the annular chamber. The annular chamber may be located between the smaller diameter portion of the tubular assembly and the sleeve, and formed by a reduced external diameter section on the smaller diameter portion and/or an increased internal diameter section on the sleeve.

In one embodiment, the tubular assembly comprises an extended member having an increased external diameter portion and a reduced internal diameter portion, and an adjustment sleeve screwed onto the reduced internal diameter portion of the extended member so as to surround a portion thereof, so that the adjustment sleeve and increased diameter portion of the extended member together form the larger external diameter portion of the tubular assembly, the shoulder being formed by an end of the adjustment sleeve. The annular chamber may then be located between the reduced diameter portion of the extended member and the adjustment sleeve, and formed by a reduced external diameter section on the reduced diameter portion of the extended member and/or an increased internal diameter section on the adjustment sleeve.

In an alternative embodiment providing an adjustable nozzle, the tool may comprise: a generally tubular assembly comprising a larger external diameter portion and a smaller external diameter portion with a shoulder therebetween; a sleeve located around the smaller external diameter portion of the tubular assembly and axially movable relative to the tubular assembly, such that the nozzle is formed between an end of the sleeve and the shoulder; and a biasing mechanism biasing the sleeve towards the shoulder, so that the nozzle is closed when the fluid pressure in the tool is below a predetermined value. An annular chamber is preferably formed adjacent to the nozzle, the tool arranged so that the annular chamber is in fluid communication with fluid supplied to the tool. The nozzle is preferably openable by fluid pressure overcoming the biasing force and moving the sleeve away from the shoulder. This means that the nozzle can be opened (and kept open) by the washing fluid itself.

The tool preferably has a fluid supply end in communication with the central cavity for connecting the tool to a fluid source. The opposite end of the tool to the fluid supply end may be closed. Alternatively, the opposite end may include an axial exit bore in fluid communication with the central cavity for receiving an axial discharge nozzle.

In a further alternative, the opposite end may be open to allow the passage of fluid, the tool further comprising a movable sleeve member located in the central cavity which restricts fluid communication between the central cavity and the nozzles and which allows fluid communication between the fluid supply end and the opposite end, said sleeve member being releasably attached to the body and including a seat for receiving a plug, the sleeve member being movable to a position in which it does not restrict fluid communication between the central cavity and the nozzles. The sleeve member is preferably releasably attached to the body by shear screws.

The inner end of the or each nozzle may be strengthened with hardened material, to counter erosion otherwise caused by the continuous passage of high pressure washing or abrasive fluid.

The invention also provides a method of washing a wellbore, comprising running a tool as described above into the wellbore and ejecting fluid through the nozzles, preferably continuously.

In accordance with another aspect of the present invention there is provided a method of washing a wellbore, comprising generating one or more jets of fluid, the or each jet taking the form of a two-dimensional sheet extending at least partially circumferentially relative to the longitudinal axis of the wellbore. The jet(s) may provide 360° coverage of the surface of the wellbore. Another method according to the invention comprises cutting a tubular by generating one or more jets of cutting fluid, the or each jet taking the form of a two-dimensional sheet extending at least partially circumferentially relative to the longitudinal axis of the tubular. Either of these methods may be carried out using a tool as described above.

Some preferred embodiments of the invention will now be described by way of example only and with reference to the accompanying drawings, in which.

Figure 1:
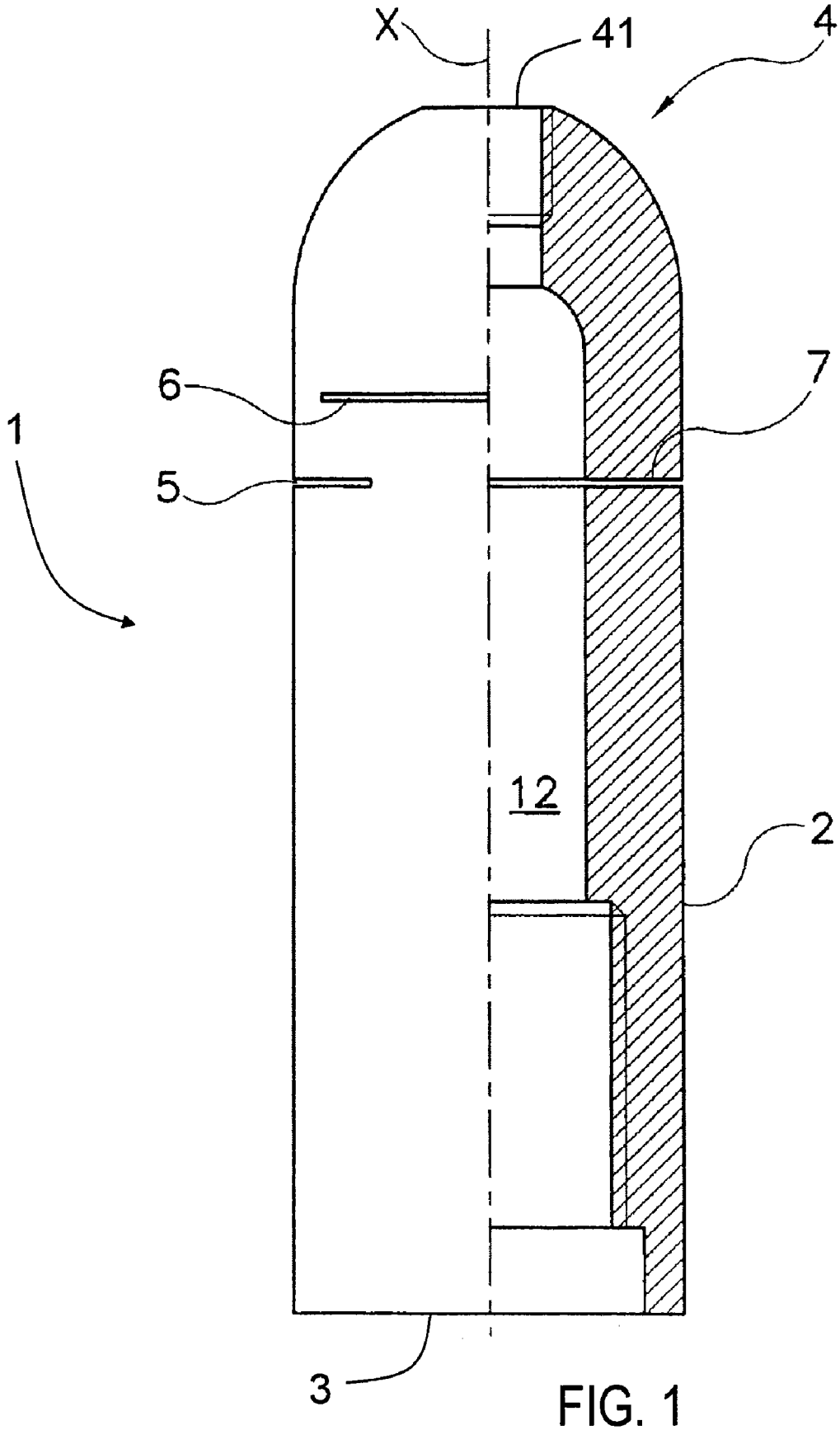
FIG. 1 is a longitudinal section view of a washing tool.

FIG. 1 shows a tool 1 for washing generally cylindrical cavities, such as those found in wellbores. The tool 1 comprises a generally cylindrical body 2 having a central cavity 12, both having the same central longitudinal axis X. A plurality of elongate, circumferentially extending nozzles 5, 6, 7 extend radially through the body 2 from the cavity 12 to the exterior of the tool 1. The nozzles are distributed so that, collectively, they provide 360° coverage around the longitudinal axis X.

The tool 1 includes an open fluid supply end 3, in communication with the cavity 12, through which washing fluid (typically water or an aqueous solution) is supplied to the tool. The washing fluid exits from the cavity 12 through the nozzles 5, 6, 7. Fluid is ejected in all radial directions from the tool and impacts the wall of a cavity or wellbore (not shown) surrounding the tool in a uniform manner. The open fluid supply end 3 has an internal threaded portion to allow mechanical connection of the washing tool to other tools or tubulars and to the fluid supply system. The tool may be connected to coiled tubing, or to other tubing strings.

Figure 6:
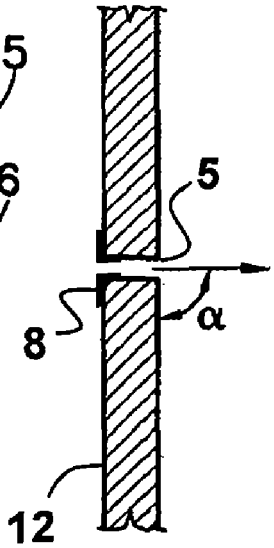
FIGS. 6, 7 and 8 show, in section, further variations to the tools of FIGS. 1 to 5.
Figure 7:
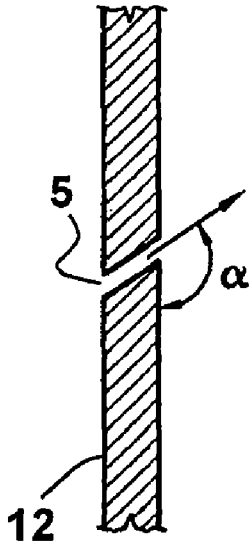
Figure 8:
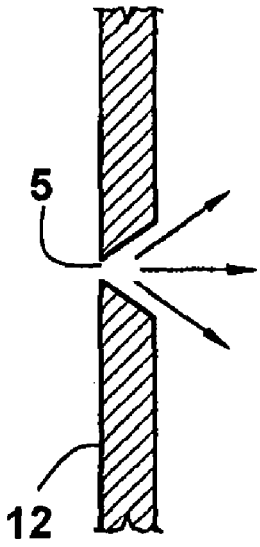

The nozzles may extend directly radially, as shown in FIG. 6, or may have an axial component so that they direct fluid with a spray angle $\alpha$ relative to the longitudinal axis X, as shown in FIG. 7. This provides a directed washing flow which may be useful, for example, for the removal and subsequent conveyance of deposits. In a further alternative the nozzles may increase in width (in the longitudinal direction of the body) through the width of the body, as shown in FIG. 8.

Figure 2:
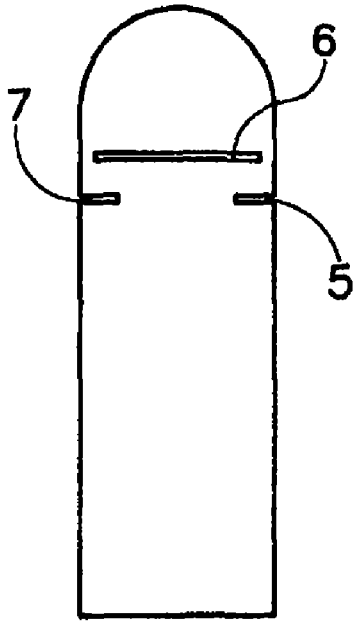
FIGS. 2, 3, 4 and 5 illustrate variations to the tool of FIG. 1.

Various configurations of nozzle are available. Each nozzle may conveniently be described as a "slot". In one embodiment, shown in FIGS. 1 and 2, the slots extend at right angles to the longitudinal axis X (i.e. purely circumferentially), and are distributed axially along the body 2 in order to give total 360° coverage. The width (in the longitudinal direction of the body) depends on the dimensions of the tool, the available delivery capacity and the particular purpose of the treatment.

Alternatively, the slots 5, 6, 7 may be distributed around the longitudinal axis X but extend over a plane which is inclined in relation to the axis of extension X. In other words, the slots may include an axial component in their direction of extension.

Figure 3:
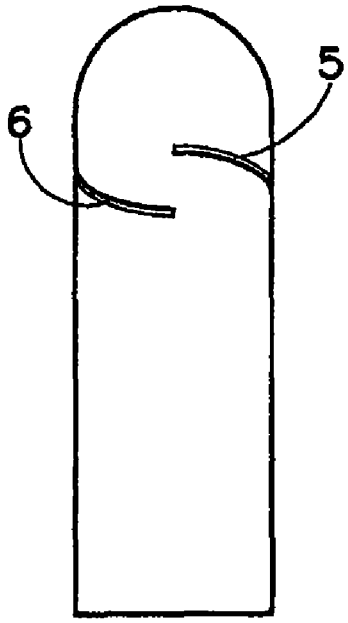
Figure 4:
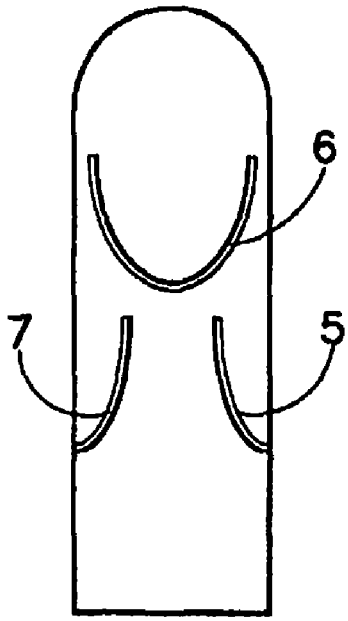
Figure 5:
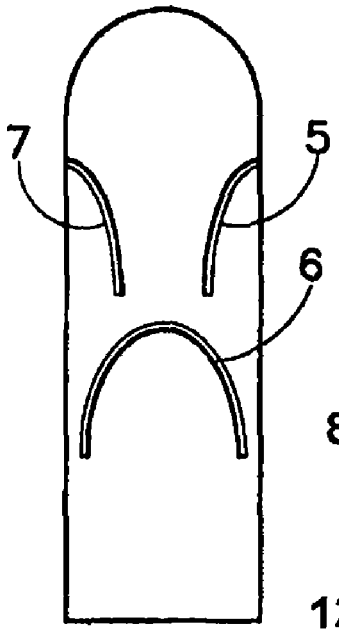

In a further alternative, the slots 5, 6 and 7 may have spiral or curved shapes, as shown in FIGS. 3, 4 and 5. It will be appreciated that combinations of flat and curved slots, or slots in different planes, may also be used.

Each of the tools shown in FIGS. 1, 2, 4 and 5 include four stationary slots, each of which extends circumferentially for at least 90°. It will be appreciated that any arrangement which the necessary circumferential coverage—usually 360°—may be used, including the use of different numbers of slots.

In a possible variation, not illustrated, the washing tool of any of FIGS. 1-6 is formed by two generally tubular bodies, fixed to each other, each of which has nozzles providing partial circumferential coverage around the axis X. The combination of the two tubulars provides complete 360° coverage around the axis X.

In many situations the tool will be surrounded in use by well fluids. If the washing fluid is to have any effect on the wall of a well after passing through the well fluids it must exit the tool at very high speed. A constant flow of high speed fluid through the elongate nozzles 5, 6, 7 may result in erosion, especially at the inner aperture of the nozzle. It is therefore preferred that hardened material 8 is provided to strengthen the nozzle, as shown in FIGS. 6, 7 and 8.

In the example shown in FIG. 1, the opposite end of the tool 4, distal to the fluid supply end 3, is generally hemispherical in shape. In the preferred embodiment an axial exit bore 41 is provided through the hemispherical end 4. The exit bore 41 is partially threaded for attachment of a nozzle (not shown), which may be used to remove any debris present in the well.

Figure 9:
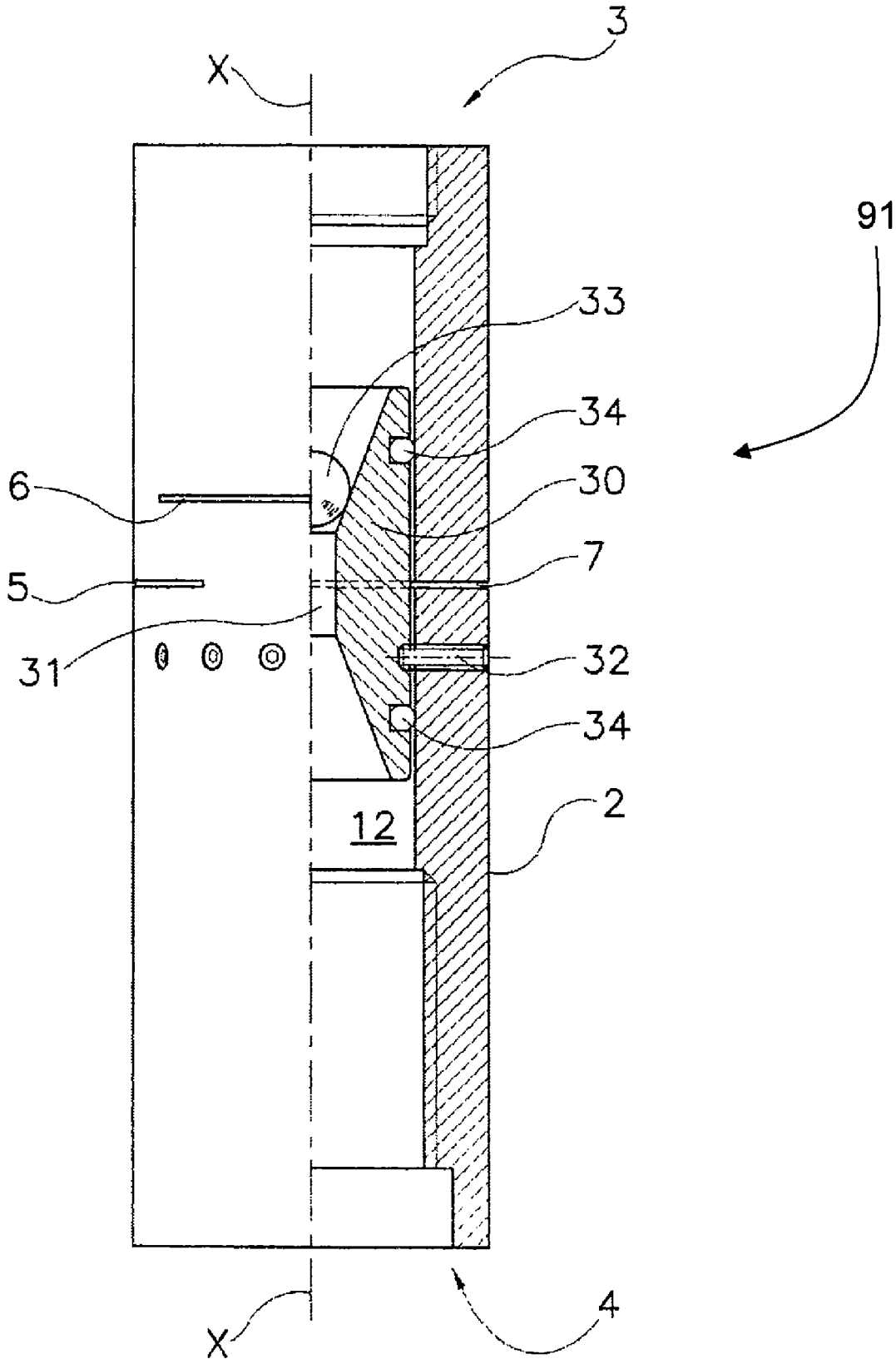
FIG. 9 is a partial section view of an alternative washing tool.

FIG. 9 illustrates an alternative tool 91, generally similar to that shown in FIG. 1, in which the distal end 4 is open and in communication with the cavity 12 of the body 2. It will be noted that the tool 91 of FIG. 9 is shown in a reversed orientation compared to the tool 1 of FIG. 1, with the fluid supply end 3 at the top of the figure and the distal end 4 at the bottom of the figure. The open distal end 4 is threaded to enable the washing tool 91 to be linked to other tools, either upstream or downstream, such as, for example, vibrating tools to assist with the movement of the tool into the well.

A slidable sleeve member 30 is located in the central cavity 12. The sleeve member 30 is generally cylindrical and includes an axial central bore 31 which allows fluid to pass through the cavity from the fluid supply end 3 to the distal end 4. The sleeve member 30 is initially located to as to cover the nozzles 5, 6, 7, preventing communication between the cavity 12 and the nozzles 5, 6, 7. Grooves are provided around the outside of the sleeve member 30 to receive sealing gaskets 34, and the sleeve member 30 is held against the body 2 by means of shear screws 32 with pre-defined breaking load. In this configuration fluid passes right through the tool from the fluid supply end 3 to the distal end 4.

The axial bore 31 is shaped so that it can act as a seat for a ball 33. When it is desired to use the tool for washing, a ball is inserted into the string, transported into the tool through the fluid supply end 3, and comes to rest against the seat formed in the axial bore 31 of the sleeve member 30. This prevents passage of fluid through the bore 31. As a result, the fluid pressure within the tool increases, causing the shear screws 32 to fail. The sleeve member 30 then moves through the tool until clear of the nozzles 5, 6, 7, which are brought into communication with the cavity 12. Fluid then exits the nozzles 5, 6, 7 to wash the surface surrounding the tool.

Figure 10:
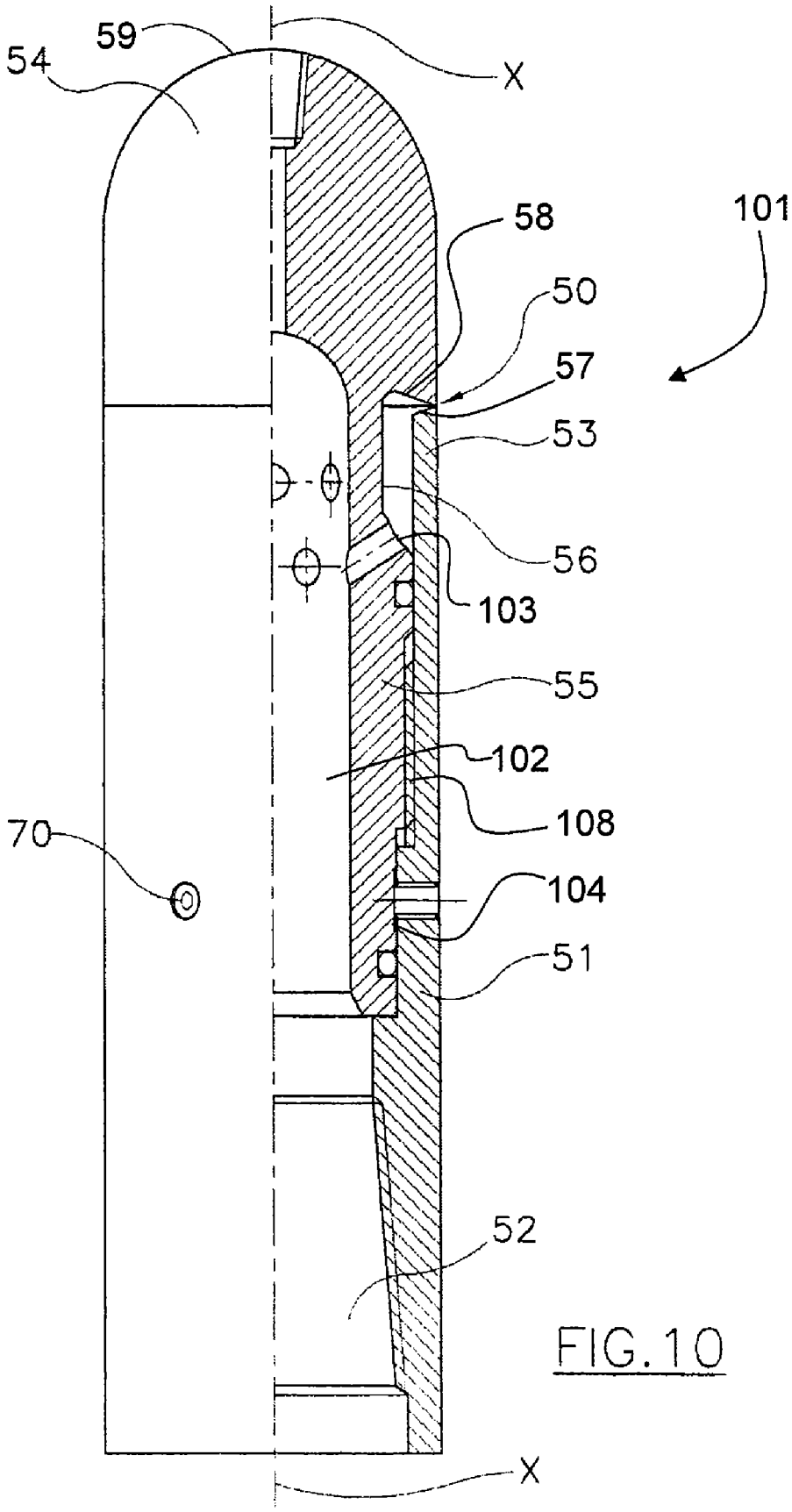
FIG. 10 shows another alternative washing tool.

FIG. 10 shows an alternative washing tool 101, similar to that shown in FIG. 1, having a nozzle in the form of single, adjustable, circular slot 50 which extends circumferentially for 360° right around the tool 101.

The tool 101 includes a generally tubular connection element 51 having an open, internally threaded, fluid supply end 52, through which washing fluid is supplied under pressure. The opposite end 53 of the connection element, distal to the fluid supply end 52, terminates in a shoulder 57 and is provided with internal threads 108, to which is secured a head element 54.

The head element 54 is formed by a generally hemispherical end portion 59, from which extends a narrower hollow stem 55 having a central cavity 102. A shoulder 58 is formed at the point where the stem 55 extends from the end portion 59. The stem 55 includes external threads which are screwed into the internal threads 58 of the distal end 53 of the connection element 51. Once the head element 54 is screwed in place, the circular slot 50 is formed between the shoulders 57, 58 on the connection element 51 and head element 54, respectively.

An annular chamber 56, in communication with the circular slot 50, is formed between the connection element 51 and the hollow stem 55. This annular chamber 56 is itself in communication with the cavity 102 of the hollow stem 55 via ports 103. The central cavity 102 communicates with the open fluid supply end 52 of the connection element 51. Washing fluid under pressure supplied through the fluid supply end 52 is thus ejected from the circular slot 50.

The width of the circular slot 50 is determined by the extent to which the stem 55 is screwed into the connection element 51. The narrowest configuration for the slot 50 is achieved when the stem 55 is screwed all the way into the connection element. Wider configurations of the slot 50 are achieved by screwing the stem 55 so that it is not all the way into the distal end 53 of the connection element 51. Locking grub screws 70 pass through the body of the connection element 51 to lock the stem in the selected position. A seat 104 for the grub screws 70 is set into the stem 55 and provides the limits for the possible widths of the slot 50. The characteristics of the washing jet can thus be controlled through the width of the nozzle.

The circular slot 50 is shown in FIG. 10 with a convergent profile, resulting in a continuous, focussed jet of washing fluid that extends all the way around the tool.

It will be appreciated that the embodiments of FIGS. 9 and 10 could be combined. The tool of FIG. 10 is shown with a hemispherical end 59 of the head element 54, but this could be replaced by an open end similar to the distal end 4 of FIG. 9. A constriction element could be shear pinned to the interior of the stem 55, arranged to cover the ports 103 and act as a seat for a ball inserted into the tool through the fluid supply end 52.

Figure 11:
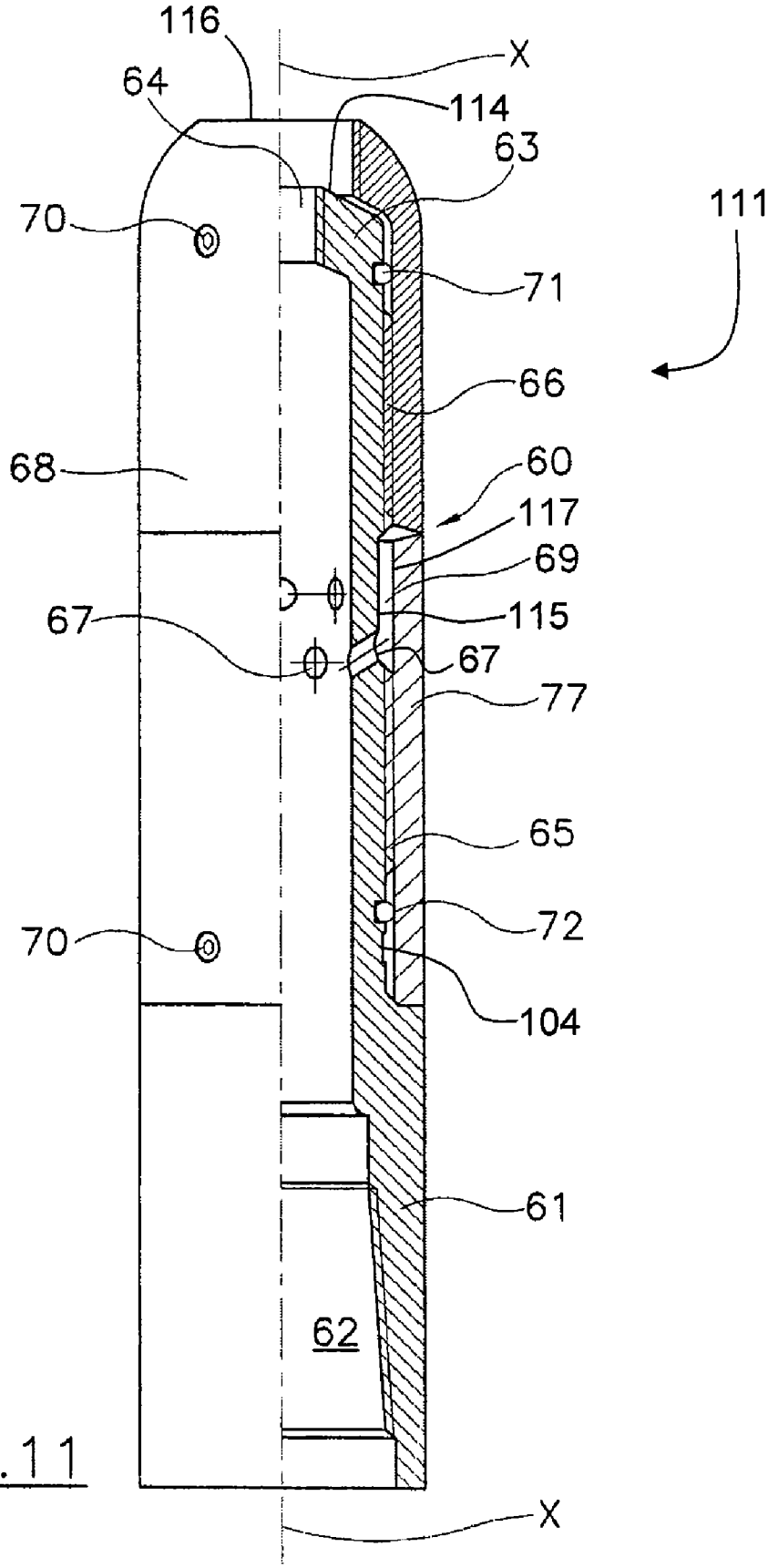
FIG. 11 shows a further alternative washing tool.

A further alternative washing tool 111 is shown in FIG. 11. The washing tool is similar to the tool 101 shown in FIG. 10, and again includes a stationary nozzle formed as an adjustable circular slot 60 which extends right around the tool so as to provide radial discharge of washing fluid in all directions.

In this embodiment the tool 111 includes an extended generally tubular element 61 having a larger diameter portion 62 and smaller diameter portion 63. The larger diameter portion 62 has an open, internally threaded fluid supply end for the supply of fluid under pressure. The smaller diameter portion 63 terminates in a distal end 114. In one embodiment (not shown) the distal end 114 is closed. In another embodiment a threaded exit bore 64 is provided through the distal end 114, the bore being coaxial with the longitudinal axis X of the tubular element 61. The bore 64 is intended to house a nozzle (not shown) for removing any debris present within the well.

The smaller diameter portion 63 of the hollow element 61 has two externally threaded sections 65, 66. The first externally threaded section 65 is adjacent to the larger diameter portion 62, and the second 66 is adjacent the distal end 114. Between these externally threaded sections 65, 66 is an intermediate section 115 of smaller external diameter than the externally threaded sections. A plurality of ports 67 are provided which extend generally radially from the interior of the body to the smaller external diameter of the intermediated section 115.

An internally threaded sleeve 77 is screwed onto the first threaded section 65 of the smaller diameter portion 63 of the tubular element 61 so that it abuts or nearly abuts the larger diameter portion 62. A internally threaded head element 68 is screwed to the second threaded section until it almost abuts the sleeve 77. The head element terminates in a generally hemispherical end which covers distal end 114 of the tubular element 61. An axial exit bore 116 may be provided in the hemispherical end to allow fluid to exit through the exit bore 64 in the distal end 114 of the tubular element 61. Seals 71, 72 are provided in circular grooves on the smaller diameter portion to seal to the head element 68 and sleeve 77, respectively.

The threaded sleeve 77 has a non-threaded internal section 116 at the end opposite that abutting the larger diameter portion 62 of the tubular element 61. The non-threaded internal section 116 sits level with the intermediate section 115 of the tubular element 61. An annular chamber 69 is defined between the reduced external diameter of the intermediate section and the non-threaded internal section of the sleeve 77. This chamber is in fluid communication with the interior of the tubular element 61 via the radial ports 67.

As previously mentioned, the head element 68 is screwed onto the second threaded section 66 until it almost abuts the sleeve 77. The gap between the head element and the sleeve defines the circular slot 60. The slot 60 is in fluid communication with the annular chamber 69 which, in turn, is in fluid communication with the interior of the tubular element 61. Fluid under pressure supplied through the open fluid supply end 62 therefore passes through the ports 67 into the annular chamber 69 and is ejected through the slot 60 in all radial directions.

The width of the slot 60 is adjustable by rotating the threaded sleeve 77 and/or the head element 68. This enables control of the characteristics of the washing jet and the treatment. The threaded sleeve 77 and the head element 68, may be locked in position by grub screws 70. As with the example shown in FIG. 10, the ends of the sleeve 77 and head element 68 may be designed so that the slot 60 has a convergent profile.

Figure 12:
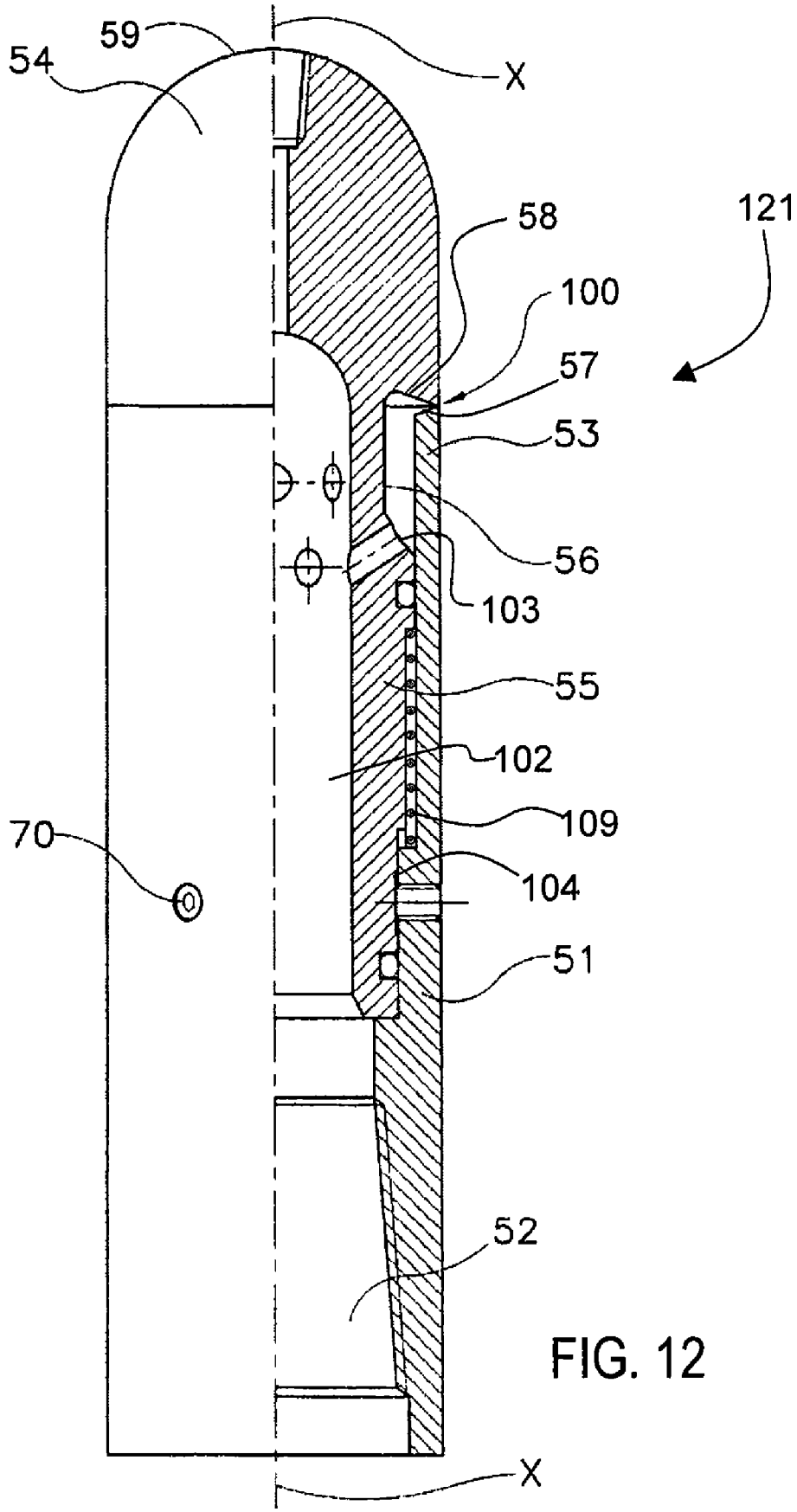

A further alternative tool 121 is shown in FIG. 12. This tool is similar to that shown in FIG. 10. In this example, the connection element 51 and head element 54 are not screwed together. Instead, a tension spring 109 (or other suitable biasing mechanism) is used to connect them. The spring 109 is attached at one end to the head member 54 and at the other end to the connection member 51, in such a way that the head member 54 is biased towards the connection member 51. A circular slot 100 is formed (in a similar manner to that shown in FIG. 10) between the shoulders 57, 58 on the connection element 51 and head element 54, respectively. When the pressure of fluid supplied to the tool is below a predetermined value, the force provided by the spring 109 closes the slot 100 by pulling the head element 54 and connection element 51 together. In order to begin a washing process, the fluid pressure is increased until it is sufficient to overcome the spring force. The head member 54 is moved longitudinally relative to the connection element 51 and the slot 100 is opened. Fluid can then pass through the ports 103 and out of the slot 100 in a similar manner to that shown in FIG. 10. Grub screws 70 pass through the body of the connection element 51. In this embodiment they are not used to lock the stem in the selected position. Instead, the seat 104 for the grub screws 70 limits the travel of the head member 54, and provides the limits for the possible widths of the slot 50.

It will be appreciated that variations from the above described embodiments may still fall within the scope of the invention. For example, the tool of FIG. 11 is described with an annular chamber 69 formed between a reduced external diameter of the tubular element and the sleeve 77. It would be possible to produce a similar chamber by increasing the internal diameter of a section of the sleeve 77.

Furthermore, the tool has been described as a tool for washing a wellbore. It will be appreciated that there are other purposes for which it could be used. For example, the tool could be used to eject sandblasting fluid or an abrasive material. The tool could then be used for abrasive cleaning and/or tubing cutting.

While the foregoing is directed to embodiments of the present invention, other and further embodiments of the invention may be devised without departing from the basic scope thereof, and the scope thereof is determined by the claims that follow.

The invention claimed is:

1. A tool for washing a wellbore or hollow tubular, the tool having a longitudinal axis and comprising:

a first tubular assembly having a shoulder and forming a cavity for receiving fluid;

a second tubular assembly coupled to an external diameter of the first tubular assembly, thereby forming a chamber for receiving fluid from the cavity, wherein one or more elongate nozzles are formed between the shoulder and the second tubular assembly for ejecting fluid from the chamber generally radially from the tool, the or each nozzle extending circumferentially around the tool.

2. A tool as claimed in claim 1, wherein the nozzle or nozzles collectively extend 360° around the longitudinal axis of the tool so that fluid is ejected in all radial directions.

3. A tool as claimed in claim 1, comprising a plurality of nozzles having complementary circumferential extension so that the nozzles collectively extend a predetermined circumferential distance around the tool.

4. A tool as claimed in claim 3, wherein the nozzles are located at a variety of axial locations.

5. A tool as claimed in claim 3, wherein some or all of the nozzles extend at a right angle to the longitudinal axis.

6. A tool as claimed in claim 3, wherein some or all of the nozzles include an axial component in their direction of extension.

7. A tool as claimed in claim 3, wherein some or all of the nozzles comprise curved slots.

8. A tool as claimed in claim 3, wherein the nozzles are arranged so that fluid exits the tool in a purely radial direction with no axial component.

9. A tool as claimed in claim 3, wherein the nozzles are arranged so that fluid exits the tool in a direction inclined axially to the radial direction.

10. A tool as claimed in claim 3, wherein the nozzles are divergent so that fluid exits the tool at a range of angles relative to purely radial.

11. A tool as claimed in claim 3, wherein the nozzles are convergent.

12. A tool as claimed in claim 3, wherein the first tubular assembly comprises a body surrounding the cavity for receiving fluid.

13. A tool as claimed in claim 1, wherein one nozzle extends 360° around the longitudinal axis of the tool.

14. A tool as claimed in claim 1, wherein the width of the or each nozzle in the axial direction is adjustable.

15. A tool as claimed in claim 14, wherein the external diameter of the first tubular assembly comprises a larger external diameter portion and a smaller external diameter portion with shoulder therebetween, at least a part of the smaller diameter portion being externally threaded; wherein the second tubular assembly comprises a sleeve, at least partially internally threaded, screwed onto the smaller external diameter portion of the first tubular assembly, such that the nozzle is formed between an end of the sleeve and the shoulder, the axial width of the nozzle being determined by the extent to which the sleeve is screwed onto the smaller diameter portion; and wherein the chamber is formed adjacent to the nozzle, the tool arranged so that the chamber is in fluid communication with fluid supplied to the cavity of the tool.

16. A tool as claimed in claim 15, wherein the sleeve and the first tubular assembly are lockable together to prevent relative axial movement therebetween.

17. A tool as claimed in claim 16, further comprising grub screws passing through the sleeve for locking the sleeve and the first tubular assembly together.

18. A tool as claimed in claim 15, wherein ports are provided in the smaller diameter portion to provide fluid communication between the cavity and the chamber.

19. A tool as claimed in claim 18, wherein the chamber is located between the smaller diameter portion of the first tubular assembly and the sleeve, the chamber being formed by a reduced external diameter section on the smaller diameter portion and/or an increased internal diameter section on the sleeve.

20. A tool as claimed in claim 18, wherein the first tubular assembly comprises:

an extended member having an increased external diameter portion and a reduced internal diameter portion; and an adjustment sleeve screwed onto the reduced internal diameter portion of the extended member so as to surround a portion thereof, so that the adjustment sleeve and increased external diameter portion of the extended member together form the larger external diameter portion of the first tubular assembly, the shoulder being formed by an end of the adjustment sleeve, and the remainder of the reduced internal diameter portion of the extended member forms the smaller diameter portion of the first tubular assembly.

21. A tool as claimed in claim 20, wherein the annular chamber is located between the reduced internal diameter portion of the extended member and the adjustment sleeve, the chamber being formed by a reduced external diameter section on the reduced internal diameter portion of the extended member and/or an increased internal diameter section on the adjustment sleeve.

22. A tool as claimed in claim 14, wherein the external diameter of the first tubular assembly comprises a larger external diameter portion and a smaller external diameter portion with the shoulder therebetween; wherein the second tubular assembly comprises a sleeve located around the smaller external diameter portion of the first tubular assembly and axially movable relative to the first tubular assembly, such that the nozzle is formed between an end of the sleeve and the shoulder; and further comprising:

a biasing mechanism biasing the sleeve towards the shoulder, so that the nozzle is closed when the fluid pressure in the tool is below a predetermined value;

wherein the chamber is formed adjacent to the nozzle, the tool arranged so that the chamber is in fluid communication with fluid supplied to the cavity of the tool;

and wherein the nozzle is openable by fluid pressure overcoming the biasing force and moving the sleeve away from the shoulder.

23. A tool as claimed in claim 12, wherein the tool has a fluid supply end in communication with the cavity for connecting the tool to a fluid source.

24. A tool as claimed in claim 23, wherein the opposite end of the tool to the fluid supply end is closed.

25. A tool as claimed in claim 23, wherein the opposite end of the tool to the fluid supply end includes an axial exit bore in fluid communication with the cavity for receiving an axial discharge nozzle.

26. A tool as claimed in claim 23, wherein the opposite end of the tool to the fluid supply end is open to allow the passage of fluid, the tool further comprising a movable sleeve member located in the cavity which restricts fluid communication between the cavity and the nozzles and which allows fluid communication between the fluid supply end and the opposite end of the tool, said sleeve member being releasably attached to the body and including a seat for receiving a plug, the sleeve member being movable in response to the receipt of the plug to a position in which it does not restrict fluid communication between the central cavity and the nozzles.

27. A tool as claimed in claim 26, wherein the sleeve member is releasably attached to the body by shear screws.

28. A tool as claimed in claim 1, wherein an inner end of the or each nozzle is strengthened with hardened material.

29. A tool as claimed in claim 1 wherein the fluid is washing fluid.

30. A tool as claimed in claim 1, wherein the fluid is sandblasting fluid.

31. A tool as claimed in claim 1, wherein the fluid is an abrasive material.

32. A method of washing a wellbore, comprising generating one or more jets of fluid using a tool as claimed in claim 1, the or each jet taking the form of a two-dimensional sheet extending at least partially circumferentially relative to the longitudinal axis of the wellbore.

33. A method as claimed in claim 32, wherein the jet or jets provide 360° coverage of the surface of the wellbore.

34. A method of washing a wellbore, comprising:

running a tool as claimed in claim 1 into the wellbore; and ejecting fluid from the tool.

35. A method as claimed in claim 34, wherein fluid is continuously ejected from the tool.

36. A tool as claimed in claim 1, wherein the nozzles are operable to eject cutting fluid for cutting a tubular.

37. A method of cutting a tubular, comprising generating one or more jets of cutting fluid using a tool as claimed in claim 1, the or each jet taking the form of a two-dimensional sheet extending at least partially circumferentially relative to the longitudinal axis of the tubular.

38. A tool for washing a wellbore or hollow tubular, the tool having a longitudinal axis and comprising:

one or more elongate nozzles for ejecting fluid generally radially from the tool, the or each nozzle extending circumferentially around the tool, wherein a width of the or each nozzle in the axial direction is adjustable;

a generally tubular assembly comprising a larger external diameter portion and a smaller external diameter portion with a shoulder therebetween, at least a part of the smaller diameter portion being externally threaded; and a sleeve, at least partially internally threaded, screwed onto the smaller external diameter portion of the tubular assembly, such that the nozzle is formed between an end of the sleeve and the shoulder, the axial width of the nozzle being determined by the extent to which the sleeve is screwed onto the smaller diameter portion, wherein an annular chamber is formed adjacent to the nozzle, the tool arranged so that the annular chamber is in fluid communication with fluid supplied to the tool.

39. A tool as claimed in claim 38, wherein the sleeve and tubular assembly are lockable together to prevent relative axial movement therebetween.

40. A tool as claimed in claim 39, further comprising grub screws passing through the sleeve for locking the sleeve and tubular assembly together.

41. A tool as claimed in claim 38, wherein the generally tubular assembly comprises a central cavity, and wherein ports are provided in the smaller diameter portion to provide fluid communication between the central cavity and the annular chamber.

42. A tool as claimed in claim 41, wherein the annular chamber is located between the smaller diameter portion of the tubular assembly and the sleeve, the annular chamber being formed by a reduced external diameter section on the smaller diameter portion and/or an increased internal diameter section on the sleeve.

43. A tool as claimed in claim 41, wherein the tubular assembly comprises:

an extended member having an increased external diameter portion and a reduced internal diameter portion; and an adjustment sleeve screwed onto the reduced internal diameter portion of the extended member so as to surround a portion thereof, so that the adjustment sleeve and increased external diameter portion of the extended member together form the larger external diameter portion of the tubular assembly, the shoulder being formed by an end of the adjustment sleeve, and the remainder of the reduced internal diameter portion of the extended member forms the smaller diameter portion of the tubular assembly.

44. A tool as claimed in claim 43, wherein the annular chamber is located between the reduced internal diameter portion of the extended member and the adjustment sleeve, the chamber being formed by a reduced external diameter section on the reduced internal diameter portion of the extended member and/or an increased internal diameter section on the adjustment sleeve.

45. A tool for washing a wellbore or hollow tubular, the tool having a longitudinal axis and comprising:

one or more elongate nozzles for ejecting fluid generally radially from the tool, the or each nozzle extending circumferentially around the tool, wherein the width of the or each nozzle in the axial direction is adjustable;

a generally tubular assembly comprising a larger external diameter portion and a smaller external diameter portion with a shoulder therebetween;

a sleeve located around the smaller external diameter portion of the tubular assembly and axially movable relative to the tubular assembly, such that the nozzle is formed between an end of the sleeve and the shoulder; and a biasing mechanism biasing the sleeve towards the shoulder, so that the nozzle is closed when the fluid pressure in the tool is below a predetermined value, wherein an annular chamber is formed adjacent to the nozzle, the tool arranged so that the annular chamber is in fluid communication with fluid supplied to the tool; and wherein the nozzle is openable by fluid pressure overcoming the biasing force and moving the sleeve away from the shoulder.

46. A tool for washing a wellbore or hollow tubular, the tool having a longitudinal axis and comprising:

a plurality of elongate nozzles for ejecting fluid generally radially from the tool, the nozzles extending circumferentially around the tool and having complementary circumferential extension so that the nozzles collectively extend a predetermined circumferential distance around the tool;

a body surrounding a central cavity for receiving fluid, the nozzles extending through the body from the central cavity to the exterior of the tool; and a fluid supply end in communication with the central cavity for connecting the tool to a fluid source, wherein the opposite end of the tool to the fluid supply end is closed.

47. A tool for washing a wellbore or hollow tubular, the tool having a longitudinal axis and comprising:

a plurality of elongate nozzles for ejecting fluid generally radially from the tool, the nozzles extending circumferentially around the tool and having complementary circumferential extension so that the nozzles collectively extend a predetermined circumferential distance around the tool;

a body surrounding a central cavity for receiving fluid, the nozzles extending through the body from the central cavity to the exterior of the tool; and a fluid supply end in communication with the central cavity for connecting the tool to a fluid source, wherein the opposite end of the tool to the fluid supply end includes an axial exit bore in fluid communication with the central cavity for receiving an axial discharge nozzle.

48. A tool for washing a wellbore or hollow tubular, the tool having a longitudinal axis and comprising:

a plurality of elongate nozzles for ejecting fluid generally radially from the tool, the nozzles extending circumferentially around the tool and having complementary circumferential extension so that the nozzles collectively extend a predetermined circumferential distance around the tool;

a body surrounding a central cavity for receiving fluid, the nozzles extending through the body from the central cavity to the exterior of the tool;

a fluid supply end in communication with the central cavity for connecting the tool to a fluid source, wherein the opposite end of the tool to the fluid supply end is open to allow the passage of fluid; and a movable sleeve member located in the central cavity which restricts fluid communication between the central cavity and the nozzles and which allows fluid communication between the fluid supply end and the opposite end of the tool, said sleeve member being releasably attached to the body and including a seat for receiving a plug, the sleeve member being movable in response to the receipt of the plug to a position in which it does not restrict fluid communication between the central cavity and the nozzles.

* * * * *

UNITED STATES PATENT AND TRADEMARK OFFICE

CERTIFICATE OF CORRECTION

PATENT NO. : 7,913,763 B2
APPLICATION NO. : 12/095109
DATED : March 29, 2011
INVENTOR(S) : D'Amico It is certified that error appears in the above-identified patent and that said Letters Patent is hereby corrected as shown below:

Column 9, Claim 21, Line 15, please delete "annular";

Column 9, Claim 26, Line 59, please delete "central".

Signed and Sealed this
Fifth Day of July, 2011

David J. Kappos

David J. Kappos
*Director of the United States Patent and Trademark Office*